US006229429B1

(12) United States Patent
Horon

(10) Patent No.: US 6,229,429 B1
(45) Date of Patent: May 8, 2001

(54) FIRE PROTECTION AND SECURITY MONITORING SYSTEM

(76) Inventor: Daniel J. Horon, 1346 S. Cleveland Ave., Saint Paul, MN (US) 55116

( * ) Notice: Subject to any disclaimer, the term of this patent is extended or adjusted under 35 U.S.C. 154(b) by 0 days.

(21) Appl. No.: 09/311,979

(22) Filed: May 14, 1999

Related U.S. Application Data

(60) Provisional application No. 60/085,621, filed on May 15, 1998.

(51) Int. Cl.[7] ..... G08B 1/00

(52) U.S. Cl. ..... 340/286.01; 340/506; 340/517; 340/521; 340/524; 340/525; 340/825.06; 340/825.36; 340/825.49

(58) Field of Search ..... 340/506, 511, 340/517, 521, 524, 525, 531, 533, 825.06, 825.36, 825.49

(56) References Cited

U.S. PATENT DOCUMENTS 5,086,385 * 2/1992 Launey et al. ..... 704/275
5,400,246 * 3/1995 Wilson et al. ..... 340/825.36 X

* cited by examiner

*Primary Examiner*—Daryl Pope
(74) *Attorney, Agent, or Firm*—Larkin, Hotfam, Daly & Lindgren, Ltd.; Frederick W. Niebuhr, Esq.

(57) ABSTRACT

A facility monitoring system includes a monitoring station receiving inputs from different control panels, each panel supporting detectors and other devices. Data from the panels are scanned, segmented into categories and presented in a standard format including a category identifying devices by type and state or condition. The monitoring station stores graphic information including site maps and floor plans to provide backgrounds, and device images positionable on the backgrounds to accurately depict device locations in the facility.

22 Claims, 12 Drawing Sheets

FIRE PROTECTION AND SECURITY MONITORING SYSTEM

This application claims the benefit of Provisional Application No. 60/085,621 entitled "Fire Protection and Security Monitoring System," filed May 15, 1998.

BACKGROUND OF THE INVENTION

The present invention relates to computerized systems for monitoring a facility such as a building or complex of several buildings, and more particularly to monitoring systems in which a central station receives inputs from several control panels, each control panel in turn supporting remote sensing devices such as smoke detectors, flow sensors and heat sensors distributed throughout the facility.

For safety and security, indoor facilities of any size can be equipped with monitoring systems that employ detectors distributed throughout the facility and a central monitoring station coupled to the detectors to receive messages. Each system can include a variety of types of detectors, e.g., smoke detectors, ion detectors and heat detectors to sense fire, flow detectors, motion detectors, and security detectors that recognize unauthorized tampering with doors or other entry points. Typically, a series of detectors are coupled in a circuit supported by a control panel, and control panels usually are capable of supporting several circuits of sensing devices.

In larger facilities, several control panels are coupled to a single central monitoring station, perhaps overseeing hundreds of detectors. While the number of detectors involved by itself increases the complexity of such larger systems, a major contributing factor is the lack of uniformity if different types of control panels are involved, particularly if the panels are supplied by different manufacturers. While key information about devices, e.g., type, location, nature of a fault or alarm indication, is common among different types of panels, the arrangement and textual representation of such information varies among panels, adding complexity and difficulty which may adversely affect an operator's response in the critical minutes immediately following an alarm, reported fault condition or other alert.

In connection with some monitoring systems, hardware converters (semiconductor chips) have been developed to translate information from different types of panels, then provide the translated information to the central monitoring station. While these devices have enhanced uniformity somewhat, they are costly and lack the power to convert all of the key information.

Along with the lack of uniformity in messages when several control panels are involved, a further difficulty of systems is the lack of flexibility to tailor written messages associated with reported alarm conditions and fault conditions.

Many present day monitoring systems include graphics capabilities for displaying an image of the monitored facility, e.g., blueprints, site maps, floor plans and similar facility representations. Providing such images in conjunction with alarm or fault reports can assist the operator in more rapidly and accurately determining the appropriate response. At the same time there is a need for visual images that more clearly direct an operator to the source of trouble and more readily suggest the appropriate response. Further, previous systems lack sufficient flexibility in adjusting images when devices are added to the system, or when locations of devices presently in the system are changed.

Therefore, it is an object of the present invention to provide a facility monitoring system in which messages from a variety of control panels are presented to an operator in a consistent, uniform format.

Another object is to provide a facility monitoring system with graphic capabilities for displaying a facility map in combination with images representing the various system devices as to type, state (or condition) and location.

A further object is to provide, in connection with a system with the foregoing graphics capabilities, a process for conveniently changing the facility image in response to adding, removing or relocating devices.

Yet another object is to provide a process for automatically advising an operator of the need to add device images to a facility image, as new devices are added to the monitoring system.

SUMMARY OF THE INVENTION

To achieve these and other objects, there is provided a facility monitoring system. The system includes a plurality of devices disposed at different selected locations throughout a monitored facility. Each device is adapted to generate a condition signal variable in response to changing conditions proximate the device, to alternatively indicate at least two different states. A facility monitoring station is provided, and has a memory for storing facility mapping information, selected location information and graphic information. The monitoring station further has an image generator coupled to receive the condition signals as inputs, and adapted to produce a composite facility image based on the inputs. The facility image includes a background map depicting the monitored facility, and a plurality of device images on the map that depict the devices. Each device image is associated with a different one of the devices. A transmission pathway links the detectors and the facility monitoring station, to provide the condition signals as further inputs to the image generator, and thus cause the generator to replace a first selected device image with a second selected device image in response to a change in the associated condition signal, thus to visually indicate a change of state with respect to the associated device. The image generator further is adapted to permit a system user to selectively position each of the device images on the map to depict the sensing locations of the associated devices.

Preferably, the second device image differs from the first device image in one or more of the characteristics of color, shape, and periodic interruption of the image display. More particularly as to color, three smoke detector images can be associated with a particular smoke detector: a green image associated with the normal, standby state; a yellow image associated with a trouble or fault state; and a red color associated with an alarm state. As to shapes, the smoke detector image can be a shape resembling the smoke detector when representing the standby condition, and might have the shape of a broken detector (e.g., two sections with confronting rough edges suggesting a breaking or tearing apart) to represent a fault condition. Periodic interruption of the display causes an image to flash, thus more immediately drawing attention to an alarm or fault condition. Various combinations of these approaches can be employed as well, e.g., a fault condition indicated by alternating "normal" and "broken" images of the detector.

Further, it is advantageous to provide device images that have shapes resembling those of their associated devices. Further, images for "modules" can be added to the facility image to indicate the locations of control input devices such as a manual pull station or a water flow switch, with respective device images shaped to resemble these devices.

Further in accordance with the present invention, there is provided a process for monitoring a facility in which a plurality of detectors, forming at least one detector circuit, are distributed throughout the facility and generate respective condition signals that vary in response to changes in predetermined conditions proximate the detectors. The process includes:

storing facility mapping information, device information including at least respective individual identifiers of a plurality of devices on a circuit, and graphic information;

based on the device information, generating a list of entries, each entry associated with one of the devices coupled to the circuit;

based on the mapping information, generating a visible background image comprising a map of the facility; and with respect to each of the entries on the list:

a. deleting the entry from the list;

b. creating a device image representing the device associated with the deleted entry; and c. displaying the device image on the facility map; and repeating a–c until all entries are deleted from the list of entries and the device images corresponding to all entries are displayed on the facility map as part of a visible composite image.

Preferably, the process further includes selectively positioning the device image on the map, to represent the location of the associated device within the monitored facility. An advantageous way to afford this capability is through use of a cursor to move device images as desired. More specifically, Windows programs utilize a hand operated cursor control commonly called a "mouse," which is used to "click on" the device image and "drag" the device image to the intended location on the facility map.

More preferably, deletion of the entry from the list and addition of the device image to the map are completed in a single "drag and drop" operation that transfers the textual entry from the list to the map, whereupon, in a manner known to those skilled in the art, the textual listing automatically replaced by the device image.

Until all of the device images have been placed onto the facility map, the remaining entries on the list serve as a reminder of the devices for which an image has not yet been installed. When the images for all new devices have been placed and properly located, the absence of entries on the list signifies completion of the task.

The ability to selectively position device images in this manner also is useful in providing for convenient updating of the facility map or floor plan to reflect the removal of a device, or the transfer of a detector or other device to a different location in the facility.

Further in accordance with the present invention there is provided a process for use in a facility monitoring system that includes a plurality of control panels and at least one detector coupled to each control panel. The detectors are disposed at different sensing locations throughout a monitored facility. A process for monitoring the facility based on inputs from the control panels proceeds as follows:

a. assembling descriptive information relating to and identifying types of control panels and types of devices that can be coupled to the control panels;

b. storing the assembled descriptive information arranged in a plurality of categories;

c. reading incoming information from a plurality of control panels;

d. comparing the incoming information with the categorized information, to identify respective segments of the incoming information and categorized information that match one another; and e. generating a textual image including the matched information segments in a format governed by said categories.

More particularly, control panels that support detectors and other devices function similarly to one another in the sense of utilizing key information about the devices that they support. However, these panels differ from one another as to certain specific items reported, the specific words used to describe certain devices and device types, and the format according to which information is presented. Accordingly, prestored, categorized information is compared to information provided by all of the panels, with the result being a uniform presentation of matched information. Accordingly, a user of the system is not subjected to a confusing array of different formats, words for specific devices, phrases for messages related to certain alarm conditions, and the like. A user is likelier to respond to an emergency condition more rapidly and by taking the appropriate action, when presented with condition alerts and action messages in a standard format.

Thus, in accordance with the present invention, a facility monitoring system can receive information from different types of control panels supporting a variety of detectors and other devices, assimilate and organize the information, and present that information to users in a standard format that facilitates an appropriate response to an alarm or other unusual condition. The system produces facility images that include background floor plans and sector maps in combination with device images that are easily selectively positioned on the background maps. Thus, images of monitored facilities are modified to more accurately depict the types of devices involved and their locations throughout the facility. Also, images are readily added, moved or deleted to update the facility image in view of adding, removing or relocating detectors and other devices.

IN THE DRAWINGS

For a further appreciation of the above and other features and advantages, reference is made to the detailed description and to the drawings, in which:

FIG. 1 schematically represents the architecture of a facility monitoring system configured according to the present invention;

DETAILED DESCRIPTION OF THE PREFERRED EMBODIMENTS

Figure 1:
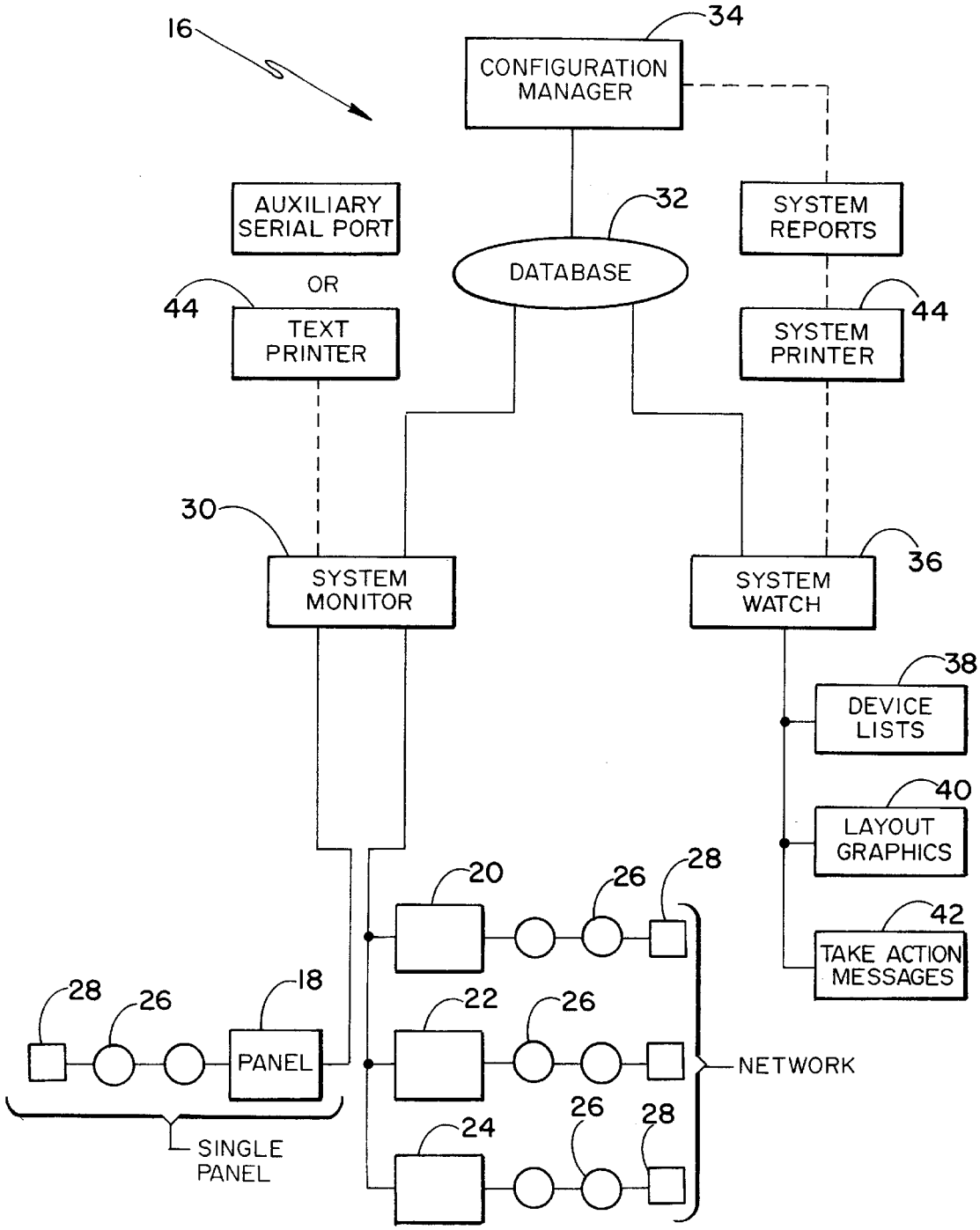

Turning now to the drawings, there is shown in FIG. 1 a system 16 for monitoring a building, complex of buildings or other facility for fire protection and other security. This figure illustrates both hardware and software (computer program) components of the system, which includes a central monitoring station and several panels and associated devices coupled to the monitoring station. The station can support a single control panel as indicated at 18, or a series of control panels at 20, 22 and 24. Each of panels 18–24 is shown as supporting a single circuit of devices including two detectors 26 and a pull station 28. In practice, individual control panels can support multiple circuits (e.g., up to 32 circuits), and each Circuit can include multiple devices.

Each control panel receives information from each of the devices on its circuit or circuits, and provides that information to the monitoring station, more particularly to a system monitor program 30 contained in a central processing unit (CPU). A personal computer incorporating a Pentium or Pentium II processor is preferred. System monitor program 30 is coupled to a database 32, a configuration manager program 34 that permits certain customizing of the system, and a system watch program 36 that generates information usable to a system operator, including device lists 3 8, graphics 40 and action messages 42. One or more printers 44 are coupled to the system to generate reports which will be discussed below.

Figure 2:
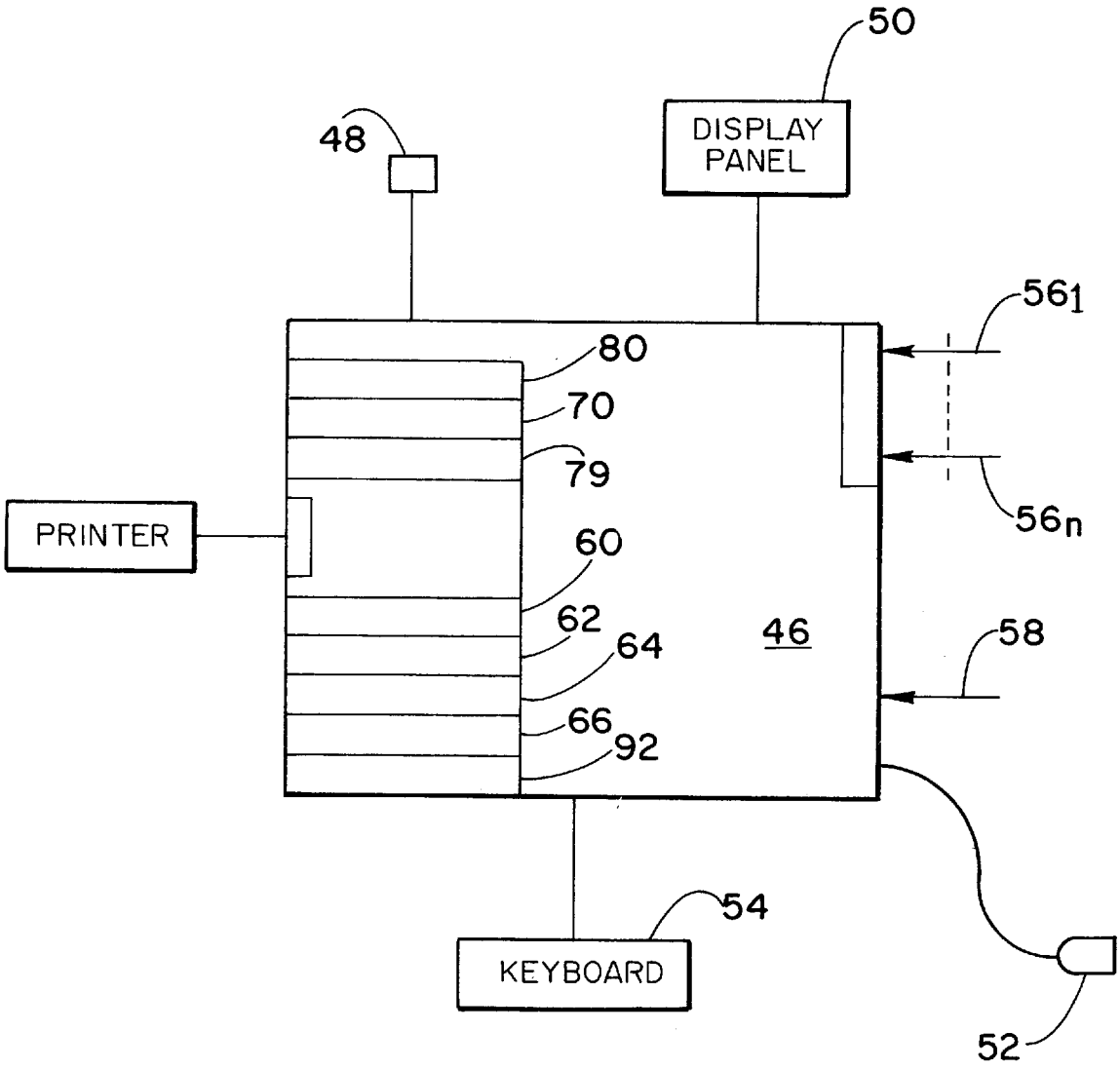
FIG. 2 is a diagram of the hardware components of the system.

The CPU is shown in FIG. 2, indicated at 46. Hardware components in addition to printer 44 include a copy protect device 48 known as a hardlock, a video display terminal 50 for showing text and graphics, a cursor control 52, and a keyboard 54 primarily for entering textual data. In some versions of the system, a cursor also can be controlled from the keyboard. However, the preferred system uses Windows (trademark) programs, in which case cursor controller 52, commonly known as a "mouse," is preferred.

In an alternative preferred version of the system, video display terminal 50 is provided in the form of a "touch panel" that presents the option for users to enter a variety of instructions by applying pressure to specified regions on the face of the displayed image. This takes the place of keyboard entry, in some cases to the point where a keyboard is not required.

Inputs from panels such as 18–24 are indicated by arrows $\mathbf{56}_l$ through $\mathbf{56}_n$. An arrow 58 indicates other inputs to the CPU from a disk drive, modem or other source of data, e.g., a building floor plan or site map to be stored in CPU 46 for later visual display.

The internal memory of CPU 46 can be conveniently considered to include separately identifiable segments for storing different types of information. These include a text segment 60 and a graphics segment 62, both of which contain "pre-stored" data. The information in text segment 60 is categorized, in the sense that it is sorted as to several types, e.g., as follows: control panel identification; device address; description of device location; device type; device state; time; zone; and group.

The panel is sometimes identified as a "node." The device address identifies the particular circuit and the location of the device along the circuit, for example "ckt 17 dev 15." The description of location locates the device with respect to the facility, e.g., "conference room A." The device type record can identify types of detectors such as "smoke detector," and also identifies "modules" that are not detectors but rather control input devices, such as a manual pull station or a water flow switch.

The device state category identifies three states with respect to detectors: a standby state indicating normal operation with no unusual condition detected; a "fault" or "trouble" state indicating that the detector may be disconnected or otherwise is not properly functioning; and an alarm state indicating the alarm condition, e.g., the sensing of heat by a heat detector. Finally, the "zone" and "group" categories relate to an option whereby an operator can associate several detectors or other devices, for example to associate a specific action instruction with a particular set of devices located in a designated section of a building.

Within each category are the specific items, e.g., entries such as "smoke detector, pull station, flow center and tamper switch" in the device type category. A user can enter additional types of devices that are not already contained in text segment 60.

Graphics segment 62 includes graphic image information of several types, including site maps, floor plans, and device image information, used to generate facility images visible on display panel 50. In particular, each of the facility images is composed of a site map or floor plan that provides a fixed (but with zoom-in and zoom-out capability) image, and one or more device images selectively positionable on the background image as is later explained. In the preferred system that uses Windows computer programs, device images are stored in Windows Metefiles format or the Enhanced Metefiles format. These formats are vector based, which allows for considerably enhanced image detail as a device image is enlarged using the zoom-in feature. As an alternative, pixel based icons can be used to represent detectors and other devices in the composite facility image.

Likewise, the vector based formats are advantageously used in storing and generating the floor plan and site map background images, with zoom-in views of floor sectors or individual rooms exhibiting more detail.

A control panel memory segment 64 stores information provided to CPU 46 by each control panel pertaining to its devices. Data entered by an operator, for example using keyboard 54, is stored to an operator input segment 66.

Figure 3:
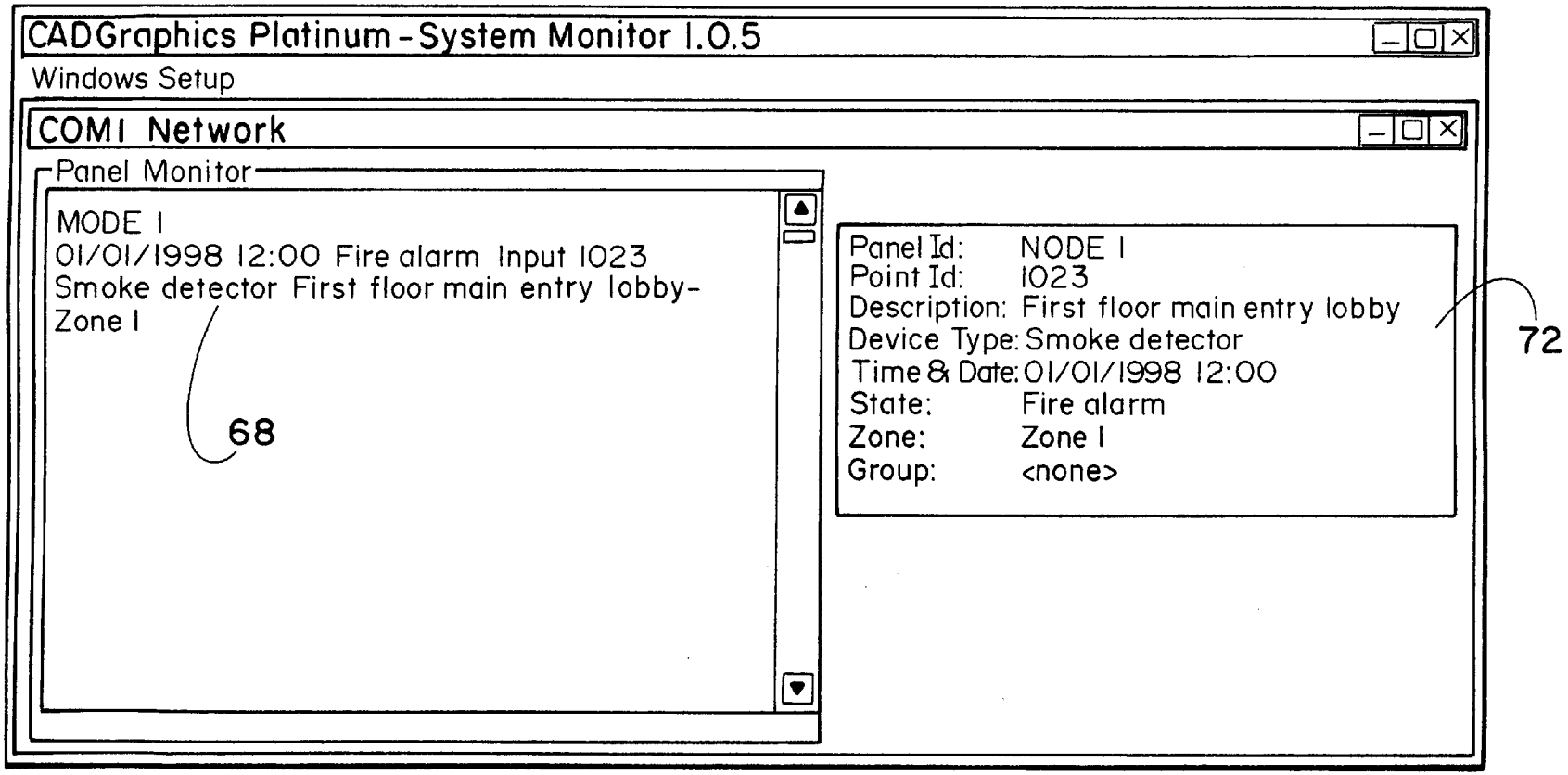
FIG. 3 is a video display representation illustrating a formatting feature of the system.

CPU 46 includes a look-up table or other suitable associative component for comparing prestored data in segments 60 with data received from the control panels and stored to control panel segment 64. FIG. 3 illustrates, on the left side, control panel information in an uncategorized format as received from one of the control panels, in this case panel 1 (node 1). Message 68 via the look-up table is compared to the entries stored in text segment 60, under the categories discussed above. When matches are found, the matched portions of data are stored to a master list segment 70 of the memory, from which the message can be displayed in a uniform format that segments the information into the different categories, as shown at 72 in FIG. 3. In short, information in a format governed by a control panel is scanned and compared with previously stored information for matches, and matching data is provided in a standard, desired format. Thus, information that may be provided in a variety of formats reflecting a variety of different control panel manufacturers, is parsed and assumes a single or universal format.

Figure 4:
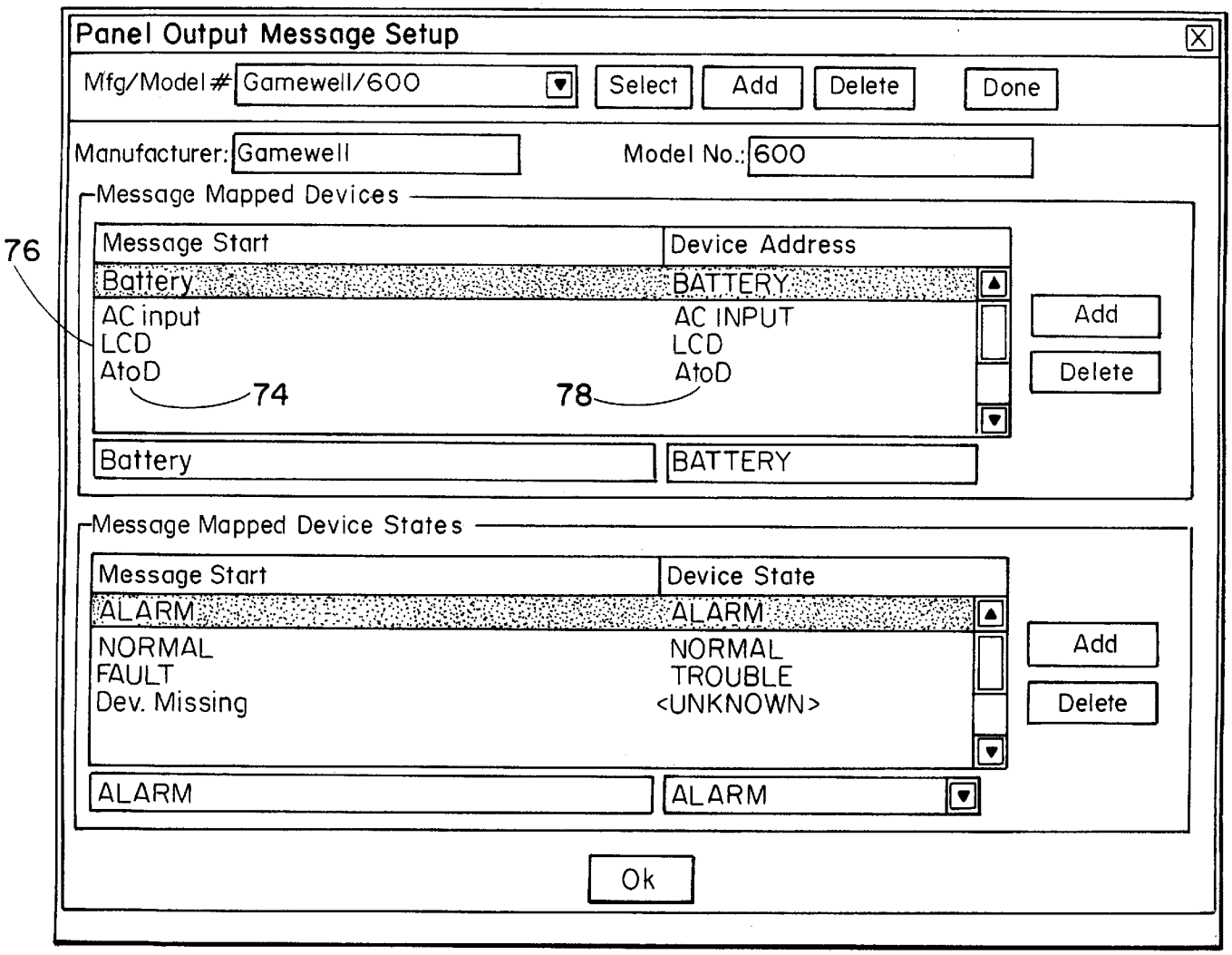
FIG. 4 is a video display representation illustrating an editing feature of the system.

Another feature of system 16 is that additional device images can be created to identify conditions beyond the states of devices previously mentioned. FIG. 4 illustrates the creation of pseudo points to identify such further conditions, e.g., that a battery is low. In a column 74 on the left of an upper display 76, the words "battery," "AC input," etc. are selected for matching entries in a previously stored list with portions of control panel messages as discussed above. To the right, a column 78 including the entries "BATTERY," "AC INPUT," etc. identify device addresses associated with the matches.

Figure 5:
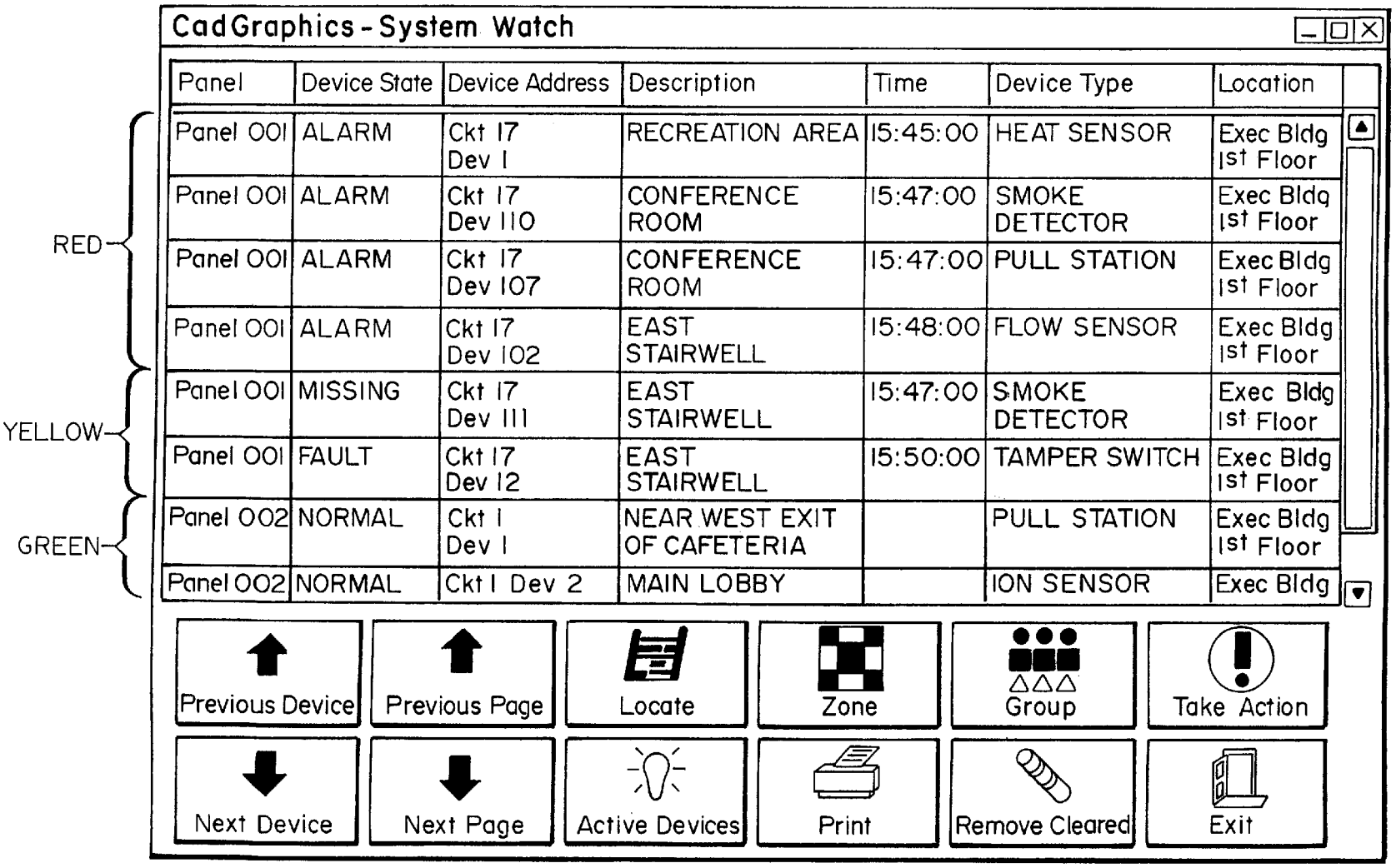
FIG. 5 is a video display representation of a list categorizing detectors and other devices of the system.

FIG. 5 illustrates a visual display of a portion of the information stored in master list segment 70. The column headings represent most of the categories previously discussed, while the horizontal rows are associated with the different devices in the system. In the multicolored display, the initial four rows provide a red background for the text, thus providing an indication of state in addition to the word "alarm" in each row under the appropriate heading. The next two rows are colored yellow to indicate the fault or troubled condition, corresponding to the words "missing" and "fault." Finally, the two rows visible at the bottom are colored green to indicate the standby or normal condition.

The video display represented in FIG. 5 is on a touch panel, featuring two rows of regions or "buttons" that can be pressed by an operator for a desired result. The "previous device" and "next device" buttons are pressed to highlight the preceding or next device. Similarly, "previous page" and "next page" buttons are used in the customary manner. The "active devices" button functions as a toggle, between a display of all devices as shown in the figure, and a display that exhibits only the active devices, i.e., devices in a state other than normal, e.g., a detector in either the alarm state or the fault state.

In addition, the display in FIG. 5 is automatically switched if necessary to display only the active devices, in response to receipt of a new active indication from any of the control panels. Thus, as soon as a potential emergency arises, the background "noise" contributed by devices in the standby state is removed, to more readily draw the user's attention to the active devices.

Figure 6:
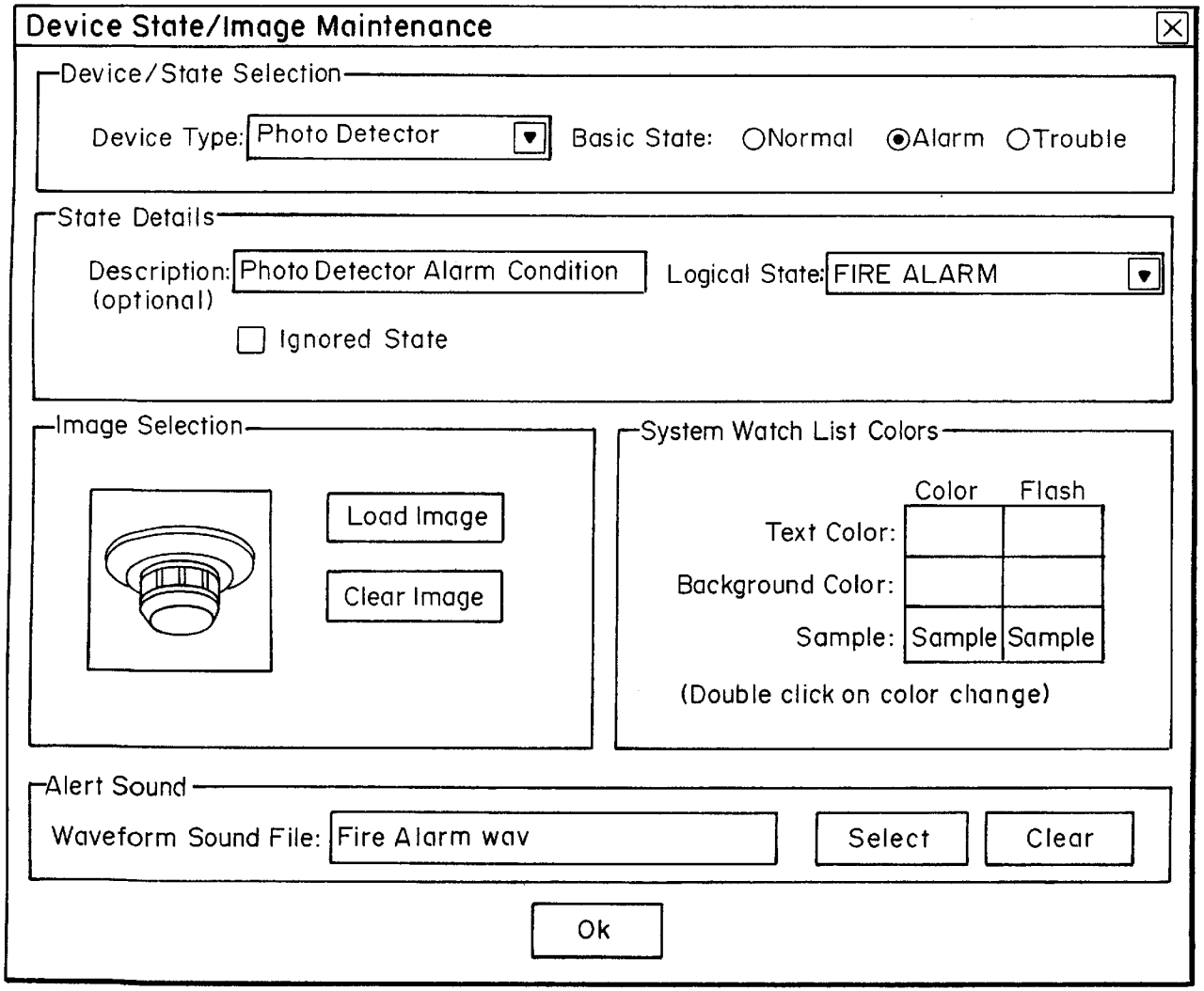
FIG. 6 is a video display representation illustrating the selection of device images corresponding to devices and device conditions or states.

A salient feature of the present system resides in the manner in which graphic information is related to textual information in general, and matched, categorized information in particular. The information in graphic segment 62 includes different device images corresponding to the different types of devices, and further includes different device images depending on the states of the devices. When text is matched, an appropriately matched/linked image is stored to a graphics segment 79 of memory. According to one preferred approach in using system 16, different device states are represented by different colors. For example, as shown in FIG. 6, a particular device (photo detector) in a particular state (alarm) is assigned the color red for consistency with the rows of devices in the alarm state shown in FIG. 5. The photo detector in the trouble or fault state is assigned the color yellow, and in connection with the normal or standby state is assigned the color green. As a result, photo detectors in composite facility images will appear green in the normal state, yellow in the fault state and red in the alarm state.

Additional display options, not illustrated, involve characteristics other than color. For example, device images can be configured for a periodically interrupted display in the composite image, producing a "flashing" effect when in the alarm state, or if desired when in the fault state as well. According to another option the shape of the device image can appear to vary from one state to another, by selecting the normal shape of the device to represent the normal state, and by selecting an image of a "broken" device, for example separate parts of a device apart from one another to indicate a breaking or tearing apart to indicate the fault state. A further option involves a combination in which a fault condition is shown by the periodically alternating display of the "normal" device image and the "broken" device image, which if properly timed exhibits the effect of animation.

Figure 7:
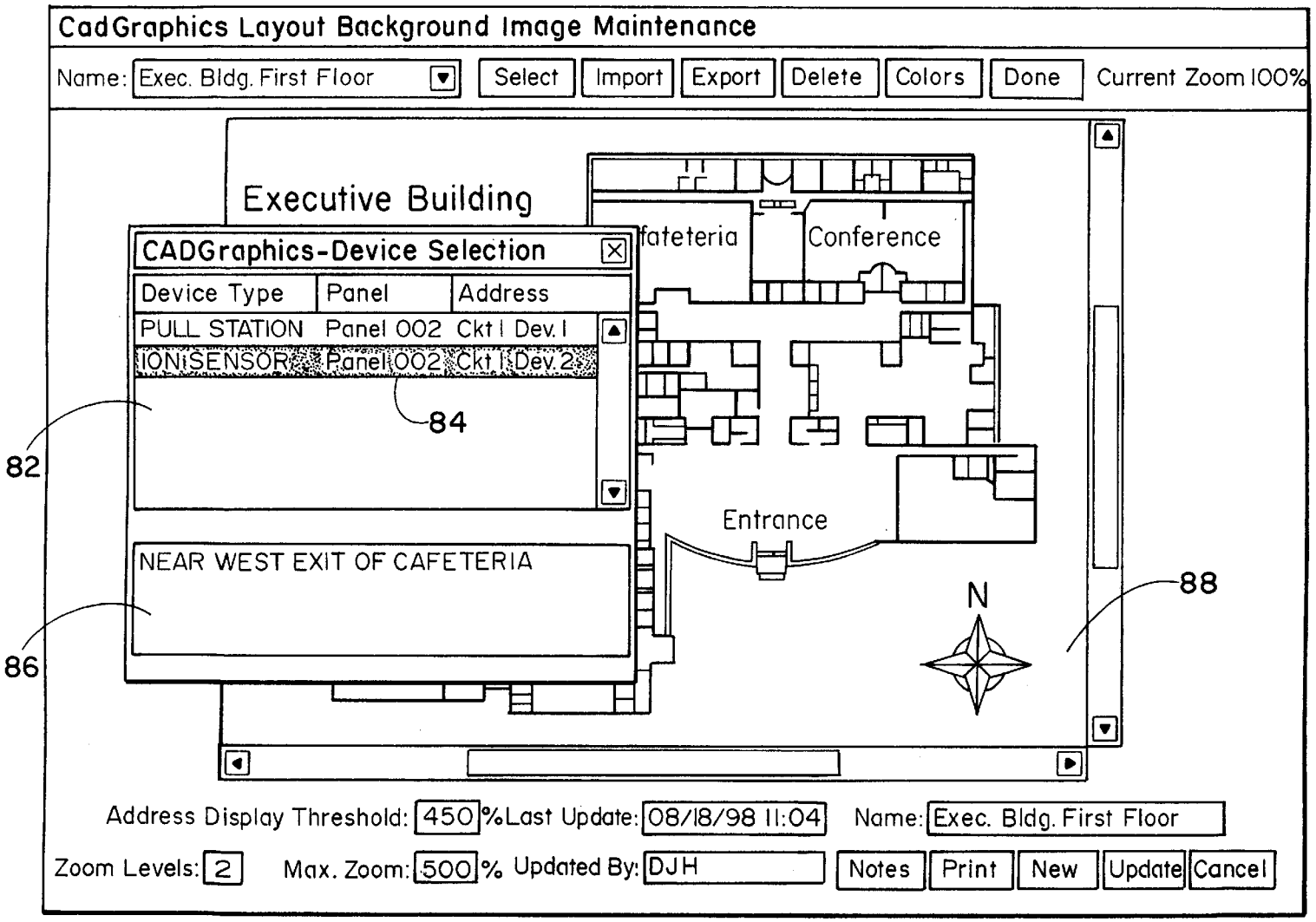
FIG. 7 is a video display representation illustrating transfer of entries from a list of devices to form images representing the devices on a facility floor plan.

When a new detector or other device is added to a circuit of one of panels 18–24, information about the device (type, location, address, etc.) is entered into the control panel, and in system 16 thus also is provided to control panel segment 64 of the memory. Further, after matching and categorizing as previously described, information regarding the new device is stored to a new device segment 80 of the memory. Devices that are "new," in the sense of not yet being represented by a device image on at least one of the composite facility images, are maintained in a list 82 that can be displayed on video display panel 50 as shown in FIG. 7. The listed devices are identified by type, panel and address. The highlighted device as indicated at 84 is further identified by a description of its location, indicated at 86.

To provide a device image representing each new device, the operator first displays list 82 in conjunction with a floor plan 88 or other background, as shown in the figure. Background image 88 may or may not already display device images. In either event, the desired image is created by controlling a cursor, typically by using a mouse to "click" the desired device entry, then "drag" the device entry on to the background image 88. The chosen entry, upon exiting list 82 and entering background image 88, is changed from the textual representation in the list to the device image corresponding to the device type. Typically at this point the image also reflects the normal or standby state.

Thus, list 82 reminds the system user of any newly installed devices that have not yet been represented in any of the composite facility images. The depletion of list 82 represents completion of task of creating at least one device image for each new device. After its installation on background image 88, the device image further can be "dragged" using the cursor control (mouse) to a location on the background image that most closely represents the actual location of the associated device in the facility.

The composite facility images, particularly when multiple devices are involved, provide displays that facilitate a rapid and appropriate response to emergency conditions, because they convey information not as readily ascertainable from textual warnings. For example, a row of red detector images along a floor plan can immediately convey information regarding how smoke from a fire is spreading down a hallway. A row of yellow devices may indicate an open circuit.

Figure 8:
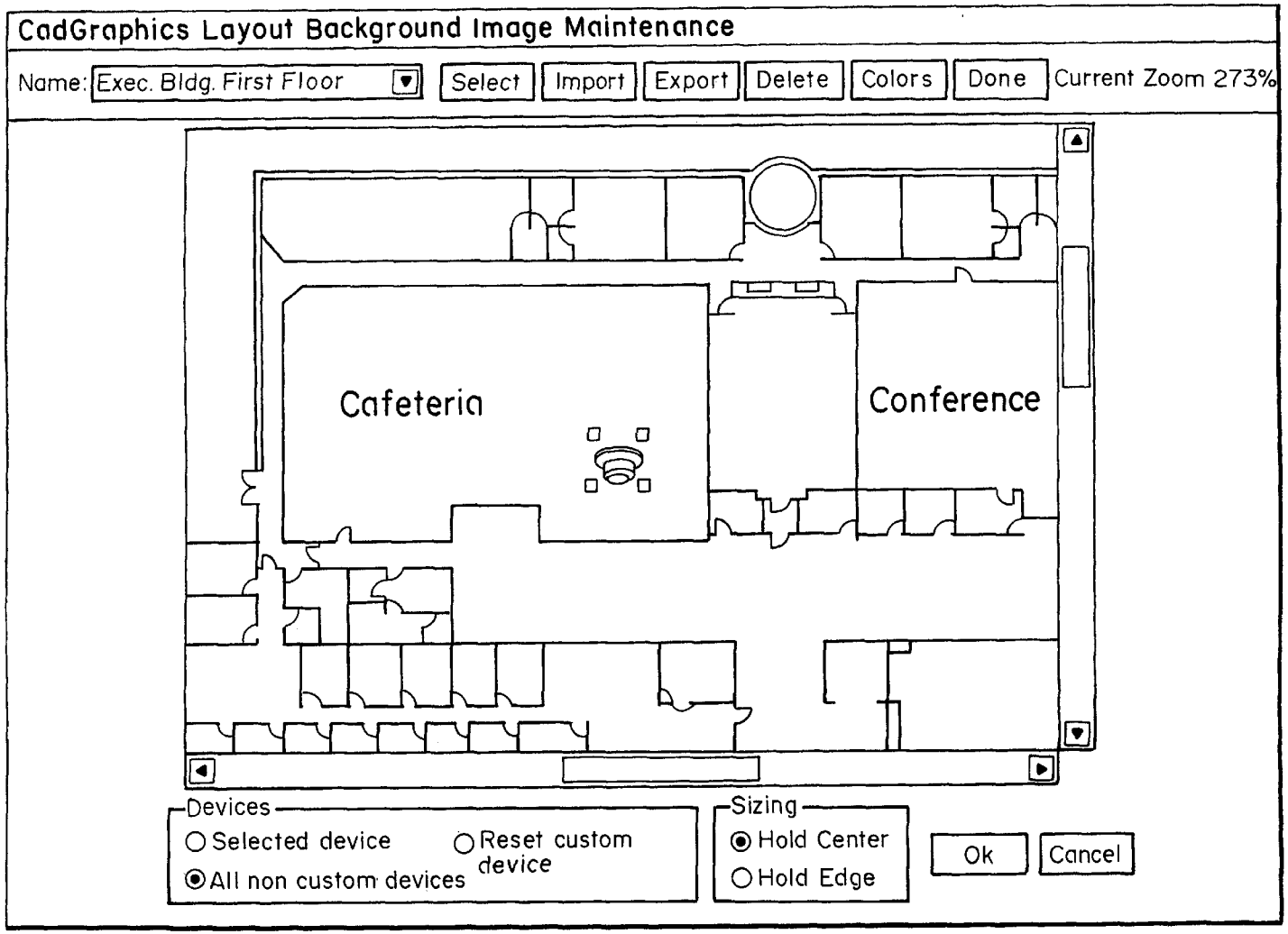
FIG. 8 is a video display representation illustrating the modification of device images.

FIG. 8 illustrates how the size of a device image can be changed. A detector image is shown and surrounded by four boxes or "grips." By controlling the mouse to hold the cursor on one of the grips, and moving the grip inward or outward, the image is reduced or enlarged.

Figure 9:
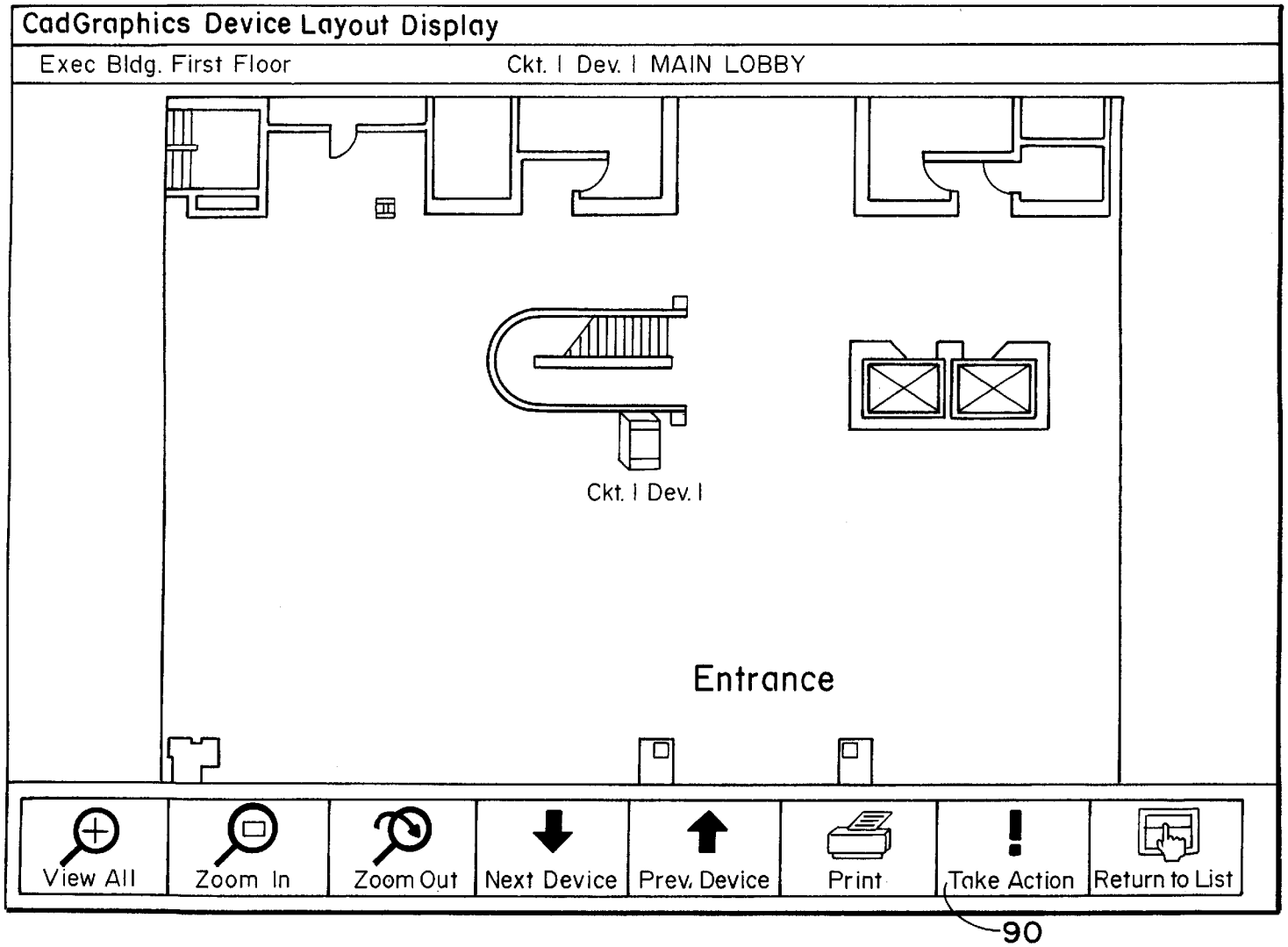
FIG. 9 is a video display representation illustrating a zoom-in feature of the system.

FIG. 9 illustrates a zoom-in feature of the system, enlarging one of the composite images to show a particular sector of a floor plan.

Figure 10:
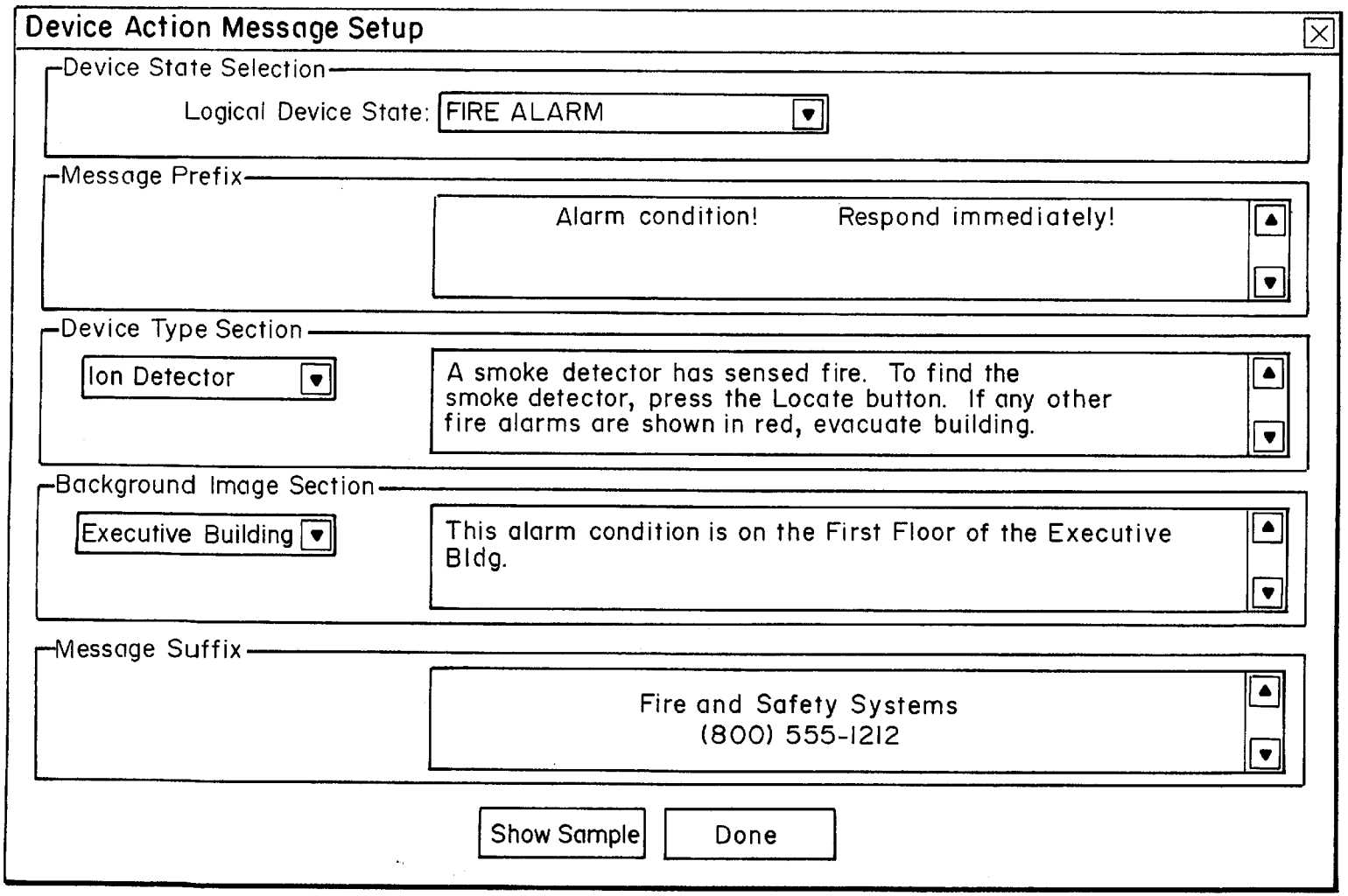
FIG. 10 is a video display representation illustrating textual messages associated with a particular device and state.
Figure 11:
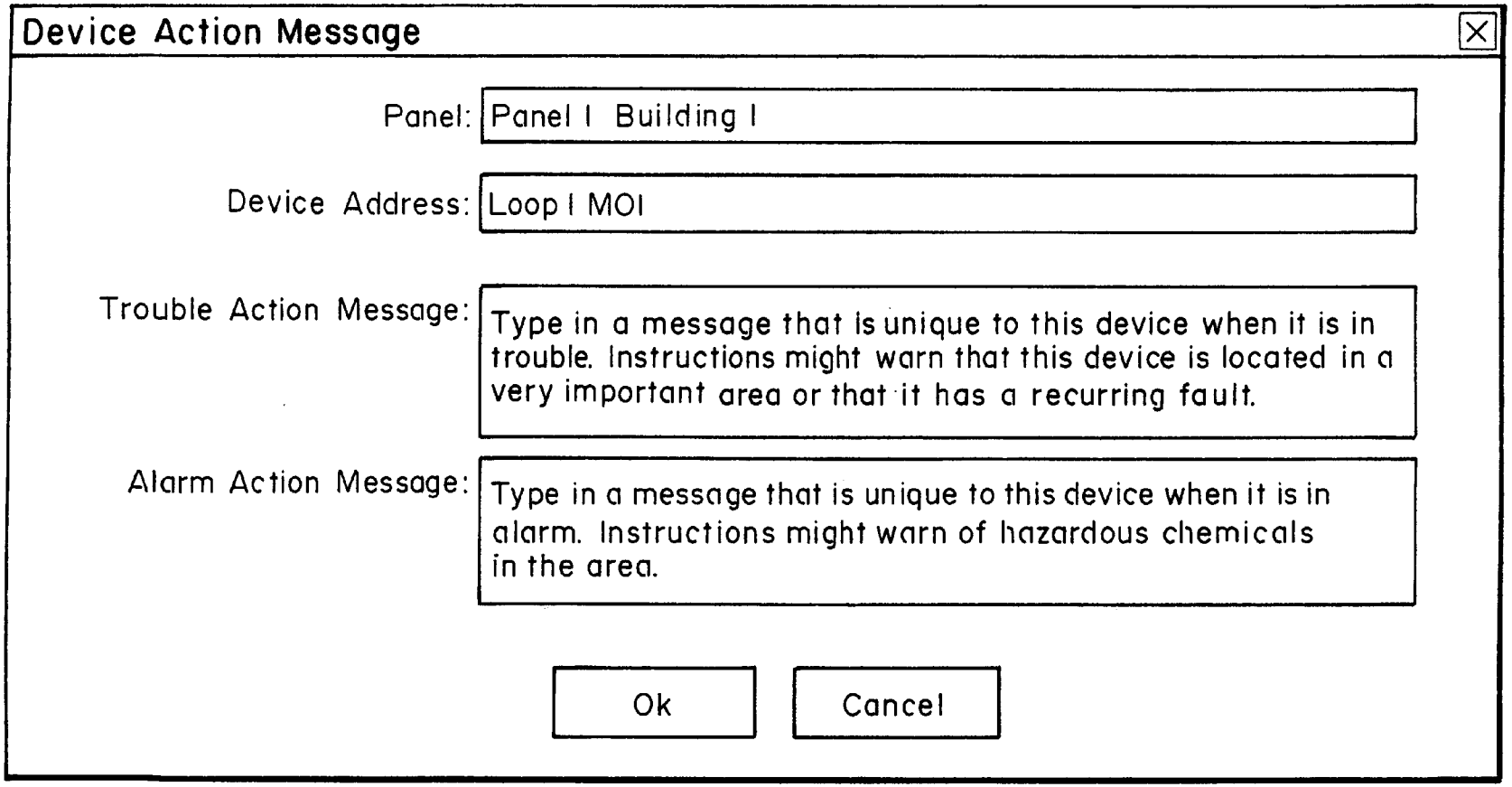
FIG. 11 is a video display representation illustrating editing of messages.

By pressing a "take action" button 90 illustrated in FIGS. 5 and 9, an operator can display a screen that reports recommended actions in view of the alarm or other condition, as shown in FIG. 10. FIG. 11 illustrates an editing feature of the system, through which the operator can provide different messages for particular devices.

Figure 12:
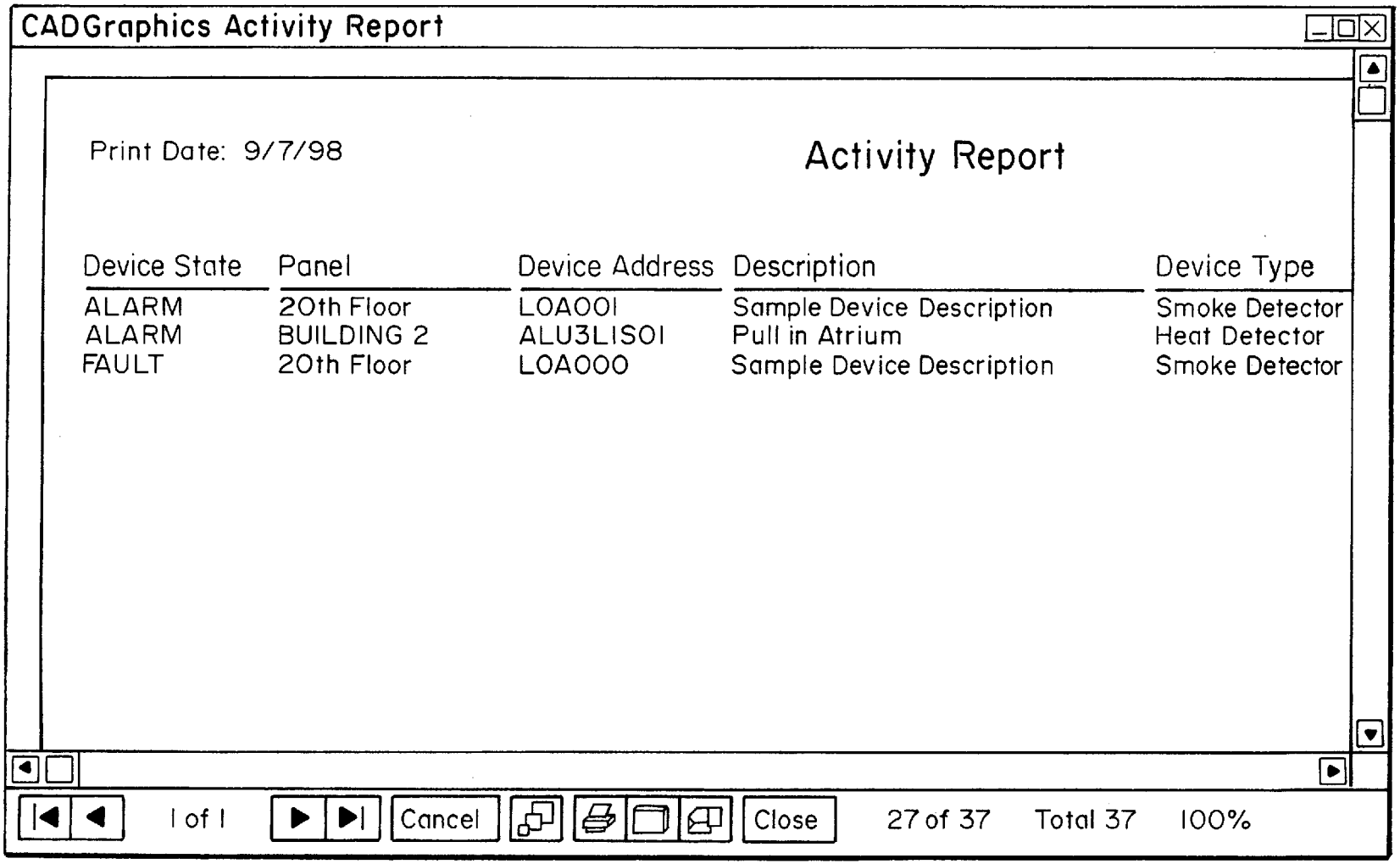
FIG. 12 is a video display representation showing a record of system activity.

According to another feature of the system, a permanent record of active state messages is stored to a report segment 92 of memory in the CPU (FIG. 2). Data stored in segment 92, shown displayed on the display panel in FIG. 12, can be printed periodically to provide a hard copy history of messages regarding other than normal conditions for all of the devices.

Thus and in accordance with the present invention, device images are easily selectively positioned on facility floor plans, site maps and other background images, to accurately depict the locations of the corresponding devices throughout the facility. Images are easily added and deleted to update each facility image to account for added and removed devices. To better insure that the facility images remain current, the addition of new devices generates a list that serves as a reminder of devices not yet depicted in composite facility images. Further, the system can receive information from different types of control panels, assimilate and categorize the information, and thus present the information to the system user in a standard format that facilitates recognition of emergency or fault conditions and promotes an appropriate response.

What is claimed is:

1. A facility monitoring system, including:

a plurality of devices disposed at different locations throughout a monitored facility, each device being adapted to generate a condition signal that varies in response to changing conditions proximate the device to alternatively indicate at least two different states;

a facility monitoring station having a memory for storing facility mapping information, location information and device image information;

said facility monitoring station further having an image generator adapted to produce a visible image including a map depicting the monitored facility and a plurality of device images displayed on the map to depict said devices, each device image being associated with a different one of the devices; and a transmission pathway for linking the devices and the facility monitoring station, to provide said condition signals as inputs to the image generator;

wherein the image generator is adapted to selectively alter the device images in response to changes in the condition signals, by altering each of the device images in response to a change in an associated condition signal generated by the associated device, thus to visually indicate a change of state with respect to the associated device; and wherein the image generator further is adapted to permit a system user to selectively position each of the device images on the map to depict the location of its associated device.

2. The system of claim 1 wherein:

said change in the associated condition signal alters at least one of the following characteristics of the associated device image: a color of the image, a shape of the image, and a periodic interrupting of the display of the image.

3. The system of claim 2 wherein:

the device image is alterable in its shape, and when representing at least one of the alternative states has a shape representing a shape of the associated device.

4. The system of claim 2 wherein:

the device image is alterable as to color, with first, second and third different colors of the device image representing respectively a standby state, a fault state, and an alarm state.

5. The system of claim 1 wherein:

said transmission pathway includes a control panel between the devices and the facility monitoring station.

6. The system of claim 5 wherein:

the facility monitoring station is coupled to the control panel in a manner to receive device information from the control panel relating to each device coupled to the control panel and thereby added to a circuit governed by the control panel, and based on the device information, generate a list of devices added to the circuit and not yet represented by an associated device image on the map.

7. The system of claim 6 wherein:

the image generator further is adapted to display a new device list in conjunction with the map, to allow use of a cursor to transfer a device listing from the new device list to the map as a device image representing the associated device and positionable to represent a location of the associated device.

8. The system of claim 7 wherein:

the image generator further is adapted to generate the device images in a plurality of shapes corresponding to a plurality of types of devices, and the facility monitoring station further includes an associative component for matching a selected one of the device image shapes to a device name in the new device list, whereby said transfer of the listed device to the map generates a device image of the selected shape corresponding to the device.

9. The system of claim 5 wherein:

the facility monitoring station is coupled to the control panel to receive textual descriptive information regarding a device entered to the control panel as the device is added to the circuit, and incorporates a parsing means for segmenting portions of the added device information into a plurality of different categories; and wherein the image generator further is adapted to display the added device information in a format governed by the categories.

10. The system of claim 1 wherein:

the memory further stores a textual instruction set associated with one of the states, and the image generator is adapted to produce an image of the instruction set after one of the condition signals provides the selected state to the image generator.

11. The system of claim 10 wherein:

the image generator further is adapted to generate the instruction set in response to a user command after receiving the indication of the selected state.

12. The system of claim 1 wherein:

said memory further is adapted for storing a list of entries, each entry in the list identifying an associated one of said plurality of devices linked to the facility monitoring station by the transmission pathway;

said facility monitoring station further includes an information management component operatively associated with the memory for generating said list of entries; and said image generator further is adapted to generate each of said device images in association with a selected one of the devices in response to a deletion of the entry on said list associated with the selected device, and to display the associated device image on the map to represent the selected device.

13. The system of claim 12 wherein:

the image generator further is adapted to display the list in conjunction with said map depicting the monitored facility, to allow a user to transfer the selected entry from the list to the map, thereby to delete the selected entry and generate the associated device image.

14. The facility monitoring system of claim 1 wherein:

said facility monitoring station includes a first control panel and a second control panel of a type different than the first control panel;

the devices include at least one first device linked by the transmission pathway to the first control panel, and at least one second device linked by the transmission pathway to the second control panel;

the memory includes a first data storage area for storing system information including at least panel and device identifying information arranged in a plurality of categories, and a second data storage area for receiving data from said control panels; and said image generator further is adapted to produce an image of the matched data, arranged in a standard format according to said categories.

15. The system of claim 14 further including:

a means for associating types of devices with different ones of the device images.

16. The system of claim 14 wherein:

the memory further is adapted to store device information from each of the control panels relating to each device coupled to the control panels, and based on the device information, generates a list of entries representing devices coupled to the facility monitoring station by the transmission pathway and not yet represented by an associated device image.

17. The system of claim 16 wherein:

the image generator further is adapted to display the list of devices so coupled and not yet represented by an associated device image in conjunction with the map, to allow use of a cursor to transfer a selected entry from the list to the map as a device image representing the associated device.

18. The system of claim 17 wherein:

the image generator further is adapted to generate the device images in a plurality of shapes corresponding to a plurality of types of devices, and an associative component is provided for matching a selected one of the device image shapes to a device name on the list, whereby said transfer of the entry to the map generates a device image of the selected shape corresponding to the device type.

19. The system of claim 14 wherein:

the memory includes a sector for storing a master list of all devices coupled to the facility monitoring station.

20. The system of claim 19 further including:

a means for selecting, from the master list, only devices that indicate a state other than a normal or standby state.

21. The system of claim 18 wherein:

the image generator further is adapted to display the visible image in a vector-based format.

22. The system of claim 1 wherein:

the image generator further is adapted to display the visible image in a vector-based format.

* * * * *